US006844808B2

(12) United States Patent
Fredericks et al.

(10) Patent No.: US 6,844,808 B2
(45) Date of Patent: Jan. 18, 2005

(54) METHOD AND APPARATUS FOR DETECTION OF WARNING SYSTEM BREACH

(75) Inventors: Thomas M. Fredericks, Westbrook, CT (US); Kenneth S. Lemieux, East Haddam, CT (US)

(73) Assignee: Whelen Engineering Company, Inc., Chester, CT (US)

( * ) Notice: Subject to any disclaimer, the term of this patent is extended or adjusted under 35 U.S.C. 154(b) by 15 days.

(21) Appl. No.: 10/420,211

(22) Filed: Apr. 22, 2003

(65) Prior Publication Data

US 2004/0212490 A1 Oct. 28, 2004

(51) Int. Cl.[7] ..... G08B 13/00

(52) U.S. Cl. ..... 340/286.04; 340/5.3; 340/10.52; 340/500

(58) Field of Search ..... 340/286.04, 500, 340/539.1, 5.3, 601, 10.52; 455/39, 403; 709/224

(56) References Cited

U.S. PATENT DOCUMENTS 4,229,734 A * 10/1980 Schultz ..... 340/512
5,282,250 A * 1/1994 Dent et al. ..... 380/247
5,875,395 A * 2/1999 Holmes ..... 455/420

* cited by examiner

*Primary Examiner*—Phung T Nguyen
(74) *Attorney, Agent, or Firm*—Alix, Yale & Ristas, LLP

(57) ABSTRACT

Base stations in an outdoor warning siren system monitor the system communication radio frequency to detect the command signals used to activate remotely located warning units. A valid command signal includes a portion identifying the base station generating the signal. When a base station detects a signal bearing its identification, the base station compares the detected signal to its own station ID. If the detected signal matches the detecting station's ID then a system breach is declared. The outdoor warning siren system may respond to a breach by automatically de-activating any alarms activated by the unauthorized signal and/or producing a breach indication to emergency personnel who may respond according to the situation.

11 Claims, 5 Drawing Sheets

METHOD AND APPARATUS FOR DETECTION OF WARNING SYSTEM BREACH

FIELD OF THE INVENTION

The present invention relates to public and industrial warning systems employing multiple remote warning units and more particularly to a method and apparatus for detecting false activation of the remote warning units.

DESCRIPTION OF THE RELATED ART

Outdoor warning sirens are the modern equivalent of what used to be known as civil defense sirens. Outdoor warning sirens are high power voice and siren systems used to notify the public of a potential safety hazard related to severe weather, darn failure, nuclear plant is emergency, chemical plant emergencies or hazardous material spills and the like. A typical outdoor warning system includes a number of warning units dispersed over a geographical area. Each of the warning units includes a high power siren and/or voice warning capability, a power supply with battery backup, a connection to the municipal power grid and a communication interface to link the remote warning units to a centralized base station. The communications link between the remote warning units and the base station typically comprises a one-way or two-way radio frequency (RF) link. In a one-way RF link system, the remote warning units are activated or deactivated by a command transmitted from the base station. Activation and deactivation of warning units operate similarly in a two-way RF link system with the additional feature that the remote warning units can communicate with the base station to relay information regarding status of the warning unit. Status reports may include an alert notifying the base station of some fault in the remote unit, such as failure of the backup power supply.

In a warning siren system, RF communications between the base station and the warning units are typically carried out in either of a dual-tone multi format (DTMF) or frequency shift keying (FSK), although other communications formats are possible.

The base station is typically located in an emergency management center where information and personnel are gathered to evaluate developing threats to public safety. Public safety personnel activate the outdoor warning system from the base station. An activation signal from the base station causes each of the remote warning units to emit a pre-determined tone and/or voice warning alerting the public to the hazard. Different tones and/or voice warnings may be assigned to each hazard and the warning units may store several warning patterns. Thus, there may be several activation commands, depending on the warning siren system configuration.

The term "base station" as used herein refers to that portion of an outdoor warning siren system used to interact with remotely located warning units. The emergency management center is typically equipped with a base radio and antenna. The outdoor warning siren system "base station" therefore typically includes an interface and audio frequency transceiver which allow the siren system to use the existing radio equipment. The "base station" may be a PC-based system or a stand alone unit. Either configuration includes a user-interface permitting emergency personnel to activate and monitor the warning siren system.

A concern raised about such public warning systems is the possibility of a system breach enabling an unauthorized party to generate a false alarm. Such a false activation might be carried out by monitoring the frequency used for communications between the base station and the warning units, recording a coded activation command when transmitted from the base station and replaying the activation command on the correct frequency. This means of false activation is available regardless of whether the activation is coded in the DTMF or FSK format.

One approach to preventing this type of system breach is to provide the base unit and warning units with synchronized clocks and to encode a time along with all system radio communications. The warning units are then programmed to reject or ignore activation command including a time stamp that does not match (or come very close to matching) the time on its clock. This approach increases the maintenance burden by requiring the clocks to be maintained in synchronicity. A particularly severe side effect of this approach is that if the proper maintenance is not performed, the clocks will be out of time and reject even a legitimate warning activation.

Time stamps and other complex data encryption algorithms often require additional, expensive hardware. The additional equipment and complexity may also result in increased maintenance expense.

There is a need in the art for a method and apparatus for detection of a system breach in an outdoor warning siren system. The method and apparatus are preferably capable of distinguishing a valid transmission from an unauthorized transmission.

SUMMARY OF THE INVENTION

The method and apparatus for detection of system breaches in outdoor warning siren systems comprises apparatus and steps for validating encoded RF transmissions used for communications between a base station and remotely located warning units. An aspect of the invention relates to the detection and validation of all command signals that could activate the warning units of an outdoor warning siren system. The invention may be as simple as the addition of computer-implemented steps to the operating software of the base station equipment, although changes to the outdoor warning siren system may be necessary.

A typical outdoor warning siren system has one or more base stations capable of transmitting encoded RF command signals to activate one or more remotely located warning units. In an exemplary embodiment of the present invention, each of the base stations is programmed to monitor the system communication radio frequency (RF). A system with a two-way RF link between the base station and the warning units will necessarily monitor the system communication RF. In a system with a one-way RF link, implementation of the exemplary embodiment of the invention may require the addition of system communication RF monitoring capability. It should be noted that the outdoor warning siren system monitoring function for a particular base station is suspended when that base station is transmitting on the system communication RF.

The present invention may be implemented by adding a security device to the existing base station equipment. The security device is a stand alone unit interfaced with the base station radio and equipped to accept inputs from emergency personnel as well as provide outputs indicating siren system status to emergency personnel. The security device may replicate the base radio interface and audio frequency protocol transceiver to provide the necessary monitoring and transmission capability. In this manner, a siren system using a one-way RF link is upgraded by interfacing the security device with the base station radio and existing alarm activation transceiver.

In an outdoor warning siren system with multiple base stations capable of transmitting an activation command, part of the coded activation command identifies the base station generating the command. An aspect of the invention relates to each base station being provided with a validation procedure. The validation procedure relies on two simple facts. The monitoring function is suspended on a transmitting base station for the brief period of transmission, e.g., a base station does not transmit and monitor at the same time; and a legitimate activation command must be generated by one of the base stations in the outdoor warning siren system. Thus, a legitimate command signal cannot be detected by a base station generating the command signal.

The validation procedure comprises computer-implemented steps of:

monitoring the system communication RF to detect command signals;

decoding detected command signals to determine the originating base station;

comparing the base station ID of the detected command signal with the detecting base station's ID; and invalidating the command signal if the base station ID included in the detected command signal matches the detecting base station's ID.

Upon detection of an invalid activation command, the outdoor warning siren system may be configured to automatically transmit a command turning off the warning units. The outdoor warning siren system may also be configured to alert relevant personnel to the detection of a system breach. The emergency personnel are then able to deal with the situation accordingly.

An object of the present invention is to provide a new and improved method and apparatus for ensuring the integrity of RF communications in outdoor warning siren systems that is compatible with existing equipment.

Another object of the present invention is to provide a new and improved method and apparatus for ensuring the integrity of RF communications in outdoor warning siren systems that is efficient and reliable.

A further object of the present invention is to provide a new and improved method and apparatus for ensuring the integrity of outdoor warning siren systems that is effective regardless of the format used to encode RF command signals from a base station to the warning units.

DETAILED DESCRIPTION OF THE PREFERRED EMBODIMENTS

Figure 1:
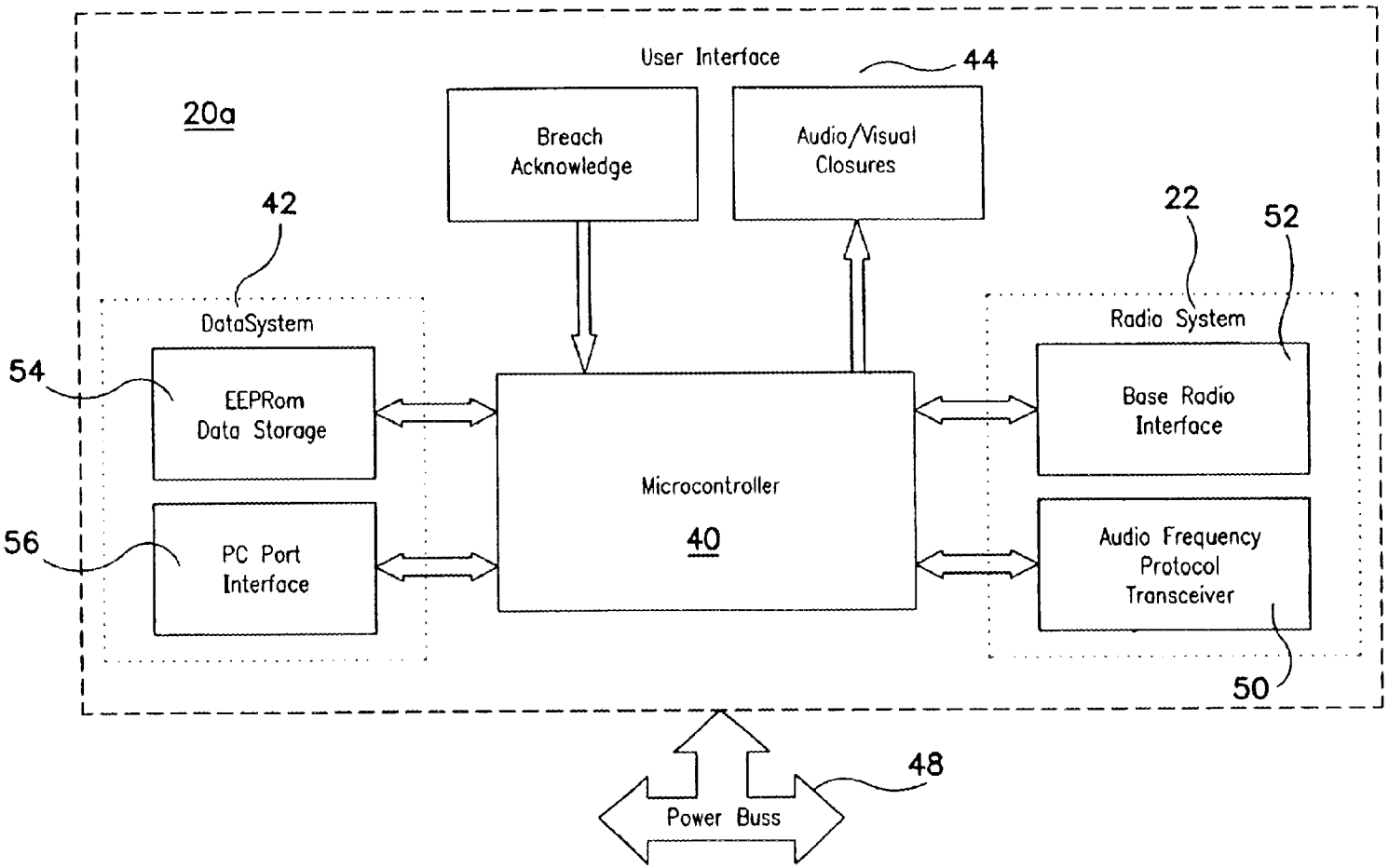
FIG. 1 is a functional block diagram of a representative security device for implementation of aspects of the method of the present invention.

An exemplary outdoor warning siren system illustrative of several aspects of the present invention is shown in FIGS. 1 through 5. The illustrated outdoor warning siren system 10 includes one or more base stations 20 and one or more remotely located warning units 30 connected to the base station by an RF link. Each warning unit 30 is includes a sound generating warning device 36 for the generation of tone and/or voice warning signals, a power supply 34 comprising a connection to the local power grid (if available) and a backup power system (usually a battery), microprocessor-based control electronics 32 and RF reception and/or transmission components 24. In some configurations, solar panels (not illustrated) may be used to charge a battery-type power supply. The control electronics 32 are preferably programmed with alternative tones and/or voice warnings corresponding to different hazards. The control electronics 32 are also equipped with a decoder/encoder for interpreting encoded command signals or encoding status signals sent to the base station 20. The radio receiver or transceiver 24 is equipped with an appropriate antenna for the reception of and/or transmission of RF signals.

One or more base stations 20 provide emergency personnel with the capability to activate the remotely located warning units 30 by transmission of command signals. FIG. 1 is a functional block diagram of an exemplary embodiment of a security device 20*a* for incorporation into or interface with a base station 20. The security device 20*a* primary functional blocks are the microcontroller 40, a user interface 44, a radio system 46, a data system and a power bus 48. The user interface 44 provides contact closures that may be configured to provide visual indications of the system status and allows emergency personnel to acknowledge a system breach by a contact closure. The radio system 46 includes a base radio interface and an audio frequency protocol (AFP) transceiver 50 in communication with the microcontroller 40. The AFP transceiver 50 encodes and transmits the command signals to the warning units 30. The data system 42 includes on-board memory 54 and may also include an interface 56 with an external computer for additional data storage. Power is distributed to the various components from the power bus 48.

It will be understood that control circuitry of the security device 20*a* is preferably implemented using a programmable microcontroller 40. Alternatively, the security device 20*a* user interface 44, data system 42 and microcontroller 40 may be emulated by software installed on a personal computer (not shown) and interfaced with a radio system 22. Whatever the physical form of the security device 20*a*, it will be understood that the security device is programmable and includes memory for storage of, for example, validation program steps and steps permitting activation of the radio system 22 to transmit a clear command.

Figure 5:
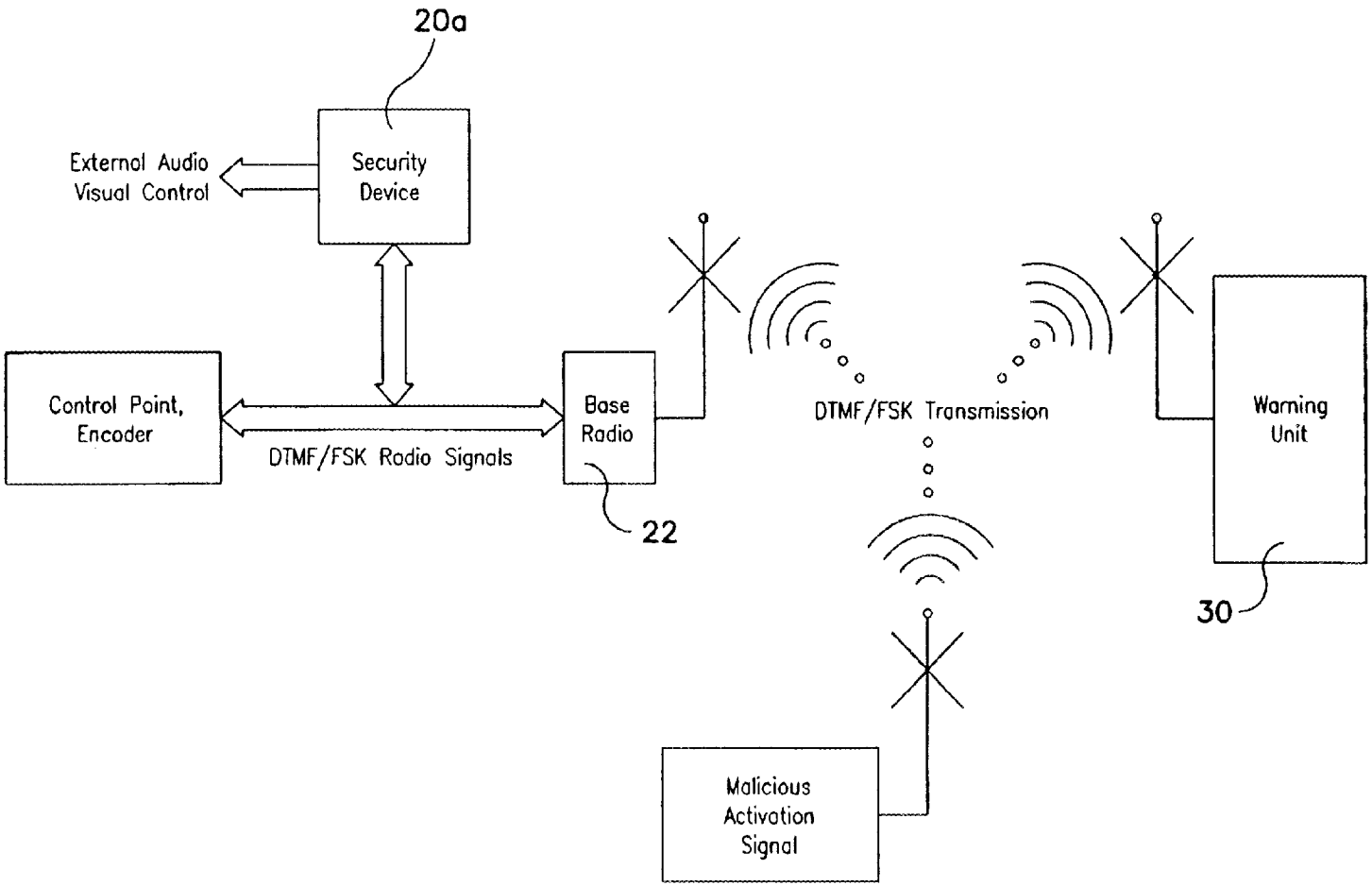
FIG. 5 is a block diagram partially illustrating an exemplary outdoor warning siren system in conjunction with a false activation signal.

The method and apparatus of the present invention may be built into the base station 20 or may be implemented as an add-on security device 20*a* as shown in FIG. 5. The security device 20*a* "learns" the base station ID of the base station to which it is attached and uses it in the validation steps as described below. This "plug and play" ease of installation allows the security device to be easily added to existing outdoor warning siren systems without disrupting the system or requiring extensive training of personnel using the system.

Figure 4:
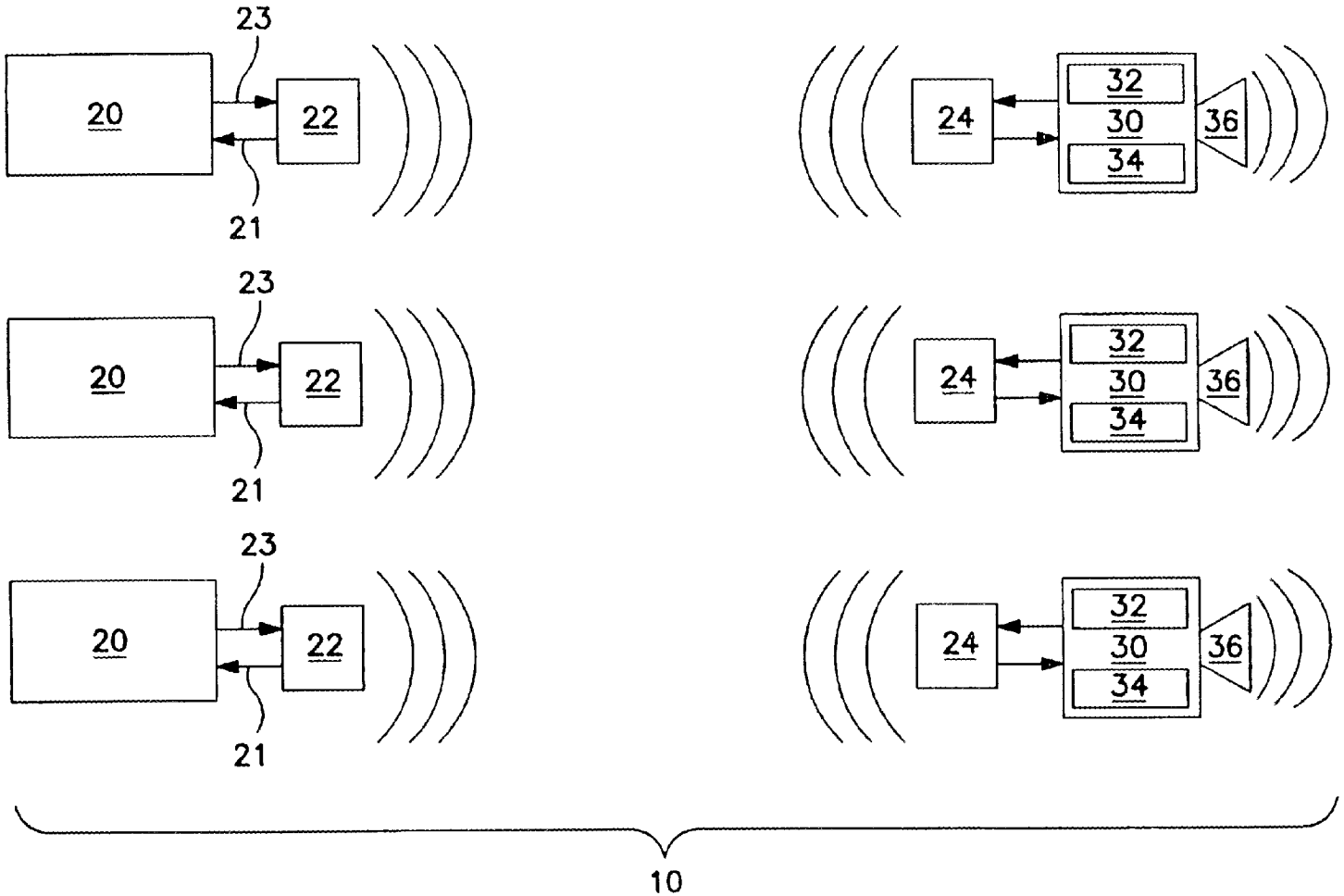
FIG. 4 is a block diagram of an exemplary outdoor warning siren system compatible with the method of the present invention.

New or existing outdoor warning siren systems may be configured as a one-way or two-way system. In a one-way outdoor warning siren system, the remotely located warning units 30 do not have the capability to transmit signals back to the base station equipment. In a two-way outdoor warning siren system 10 as shown in FIG. 4, each of the remotely located warning units 30 is coupled to the base stations 20 by a two-way RF link. Typically, the outgoing RF link 23 from the base station 20 to the warning units 30 is used for commands from the base station to the warning unit to turn on, turn off, test, or request a status report from the warning units. The incoming RF link 21 from the warning unit 30 to the base station 20 is typically used for regular status reports from the warning unit and may also include requests for maintenance or notifications of a fault from the warning unit to the base station.

In the representative outdoor warning siren system 10, command signals from the base station 20 to the warning units 30 have a particular format, for example, a ten-digit DTMF string. Returning signals from the warning units 30 to the base station 20 have a different format, for example, a fourteen- to eighteen-digit DTMF string.

An aspect of the invention relates to monitoring the system communication RF and computer implemented steps that validate detected command signals. A security device 20*a* in accordance with the present invention includes the monitoring capability even if the existing base station 20 to which it is added does not. In an outdoor warning siren system configured for two way communications, the security device may be implemented without changes to the existing hardware.

In accordance with a further aspect of the present invention, each transmission from a base station 20 includes an encoded portion associating the transmission with the base station that generated it. Each base station 20 or security device 20*a* is programmed to monitor the system communication RF. Upon detection of a command signal, the base station 20 or security device 20*a* decodes the signal to determine the originating base station ID. If the detected command signal indicates that the detecting base station was the originating base station, the signal is determined to be invalid and indicative of a system breach. If the detected signal contains the base station ID of another of the base stations; the detecting base station ignores the command signal.

A further aspect of the present invention relates to how an outdoor warning siren system improved according to the present invention reacts to detection of an invalid command signal. The base station 20 or security device 20*a* may be configured to automatically transmit a command signal turning off any warning units activated by the invalid control signal. This option is indicated at steps 100 (Yes), 102 (Yes) and 104 of FIG. 2. Another option is to alert authorized personnel to the system breach so that they may deal with the situation as they see fit. This option is indicated at steps 100 (Yes), 102 (No) and 106. Step 106 corresponds to sending notice to relevant personnel that a system breach has occurred. This may include visual and/or audio alarm indications at the base station. In either case, the invention provides a reliable means for detecting invalid command signals in an outdoor warning siren system.

Data System

The data system 42 is comprised of the EEPRom Data Storage 54 and PC Port Interface 56 functional blocks. The data system 42 provides a means by which an end-user can enter, store, view or change system configuration data.

Figure 2:
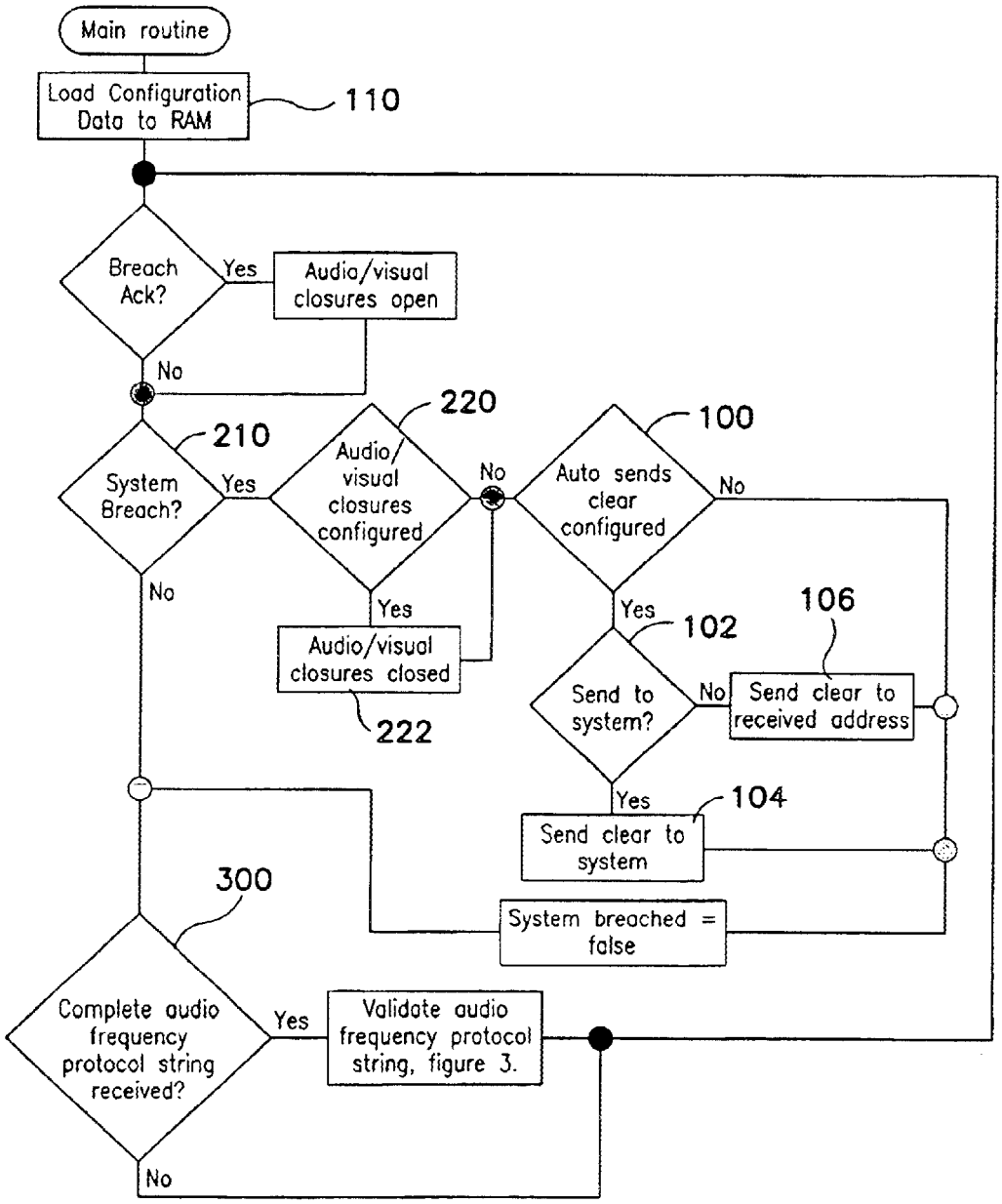
FIG. 2 is a flow chart of a main routine for a security sub system according to aspects of the present invention.
Figure 3:
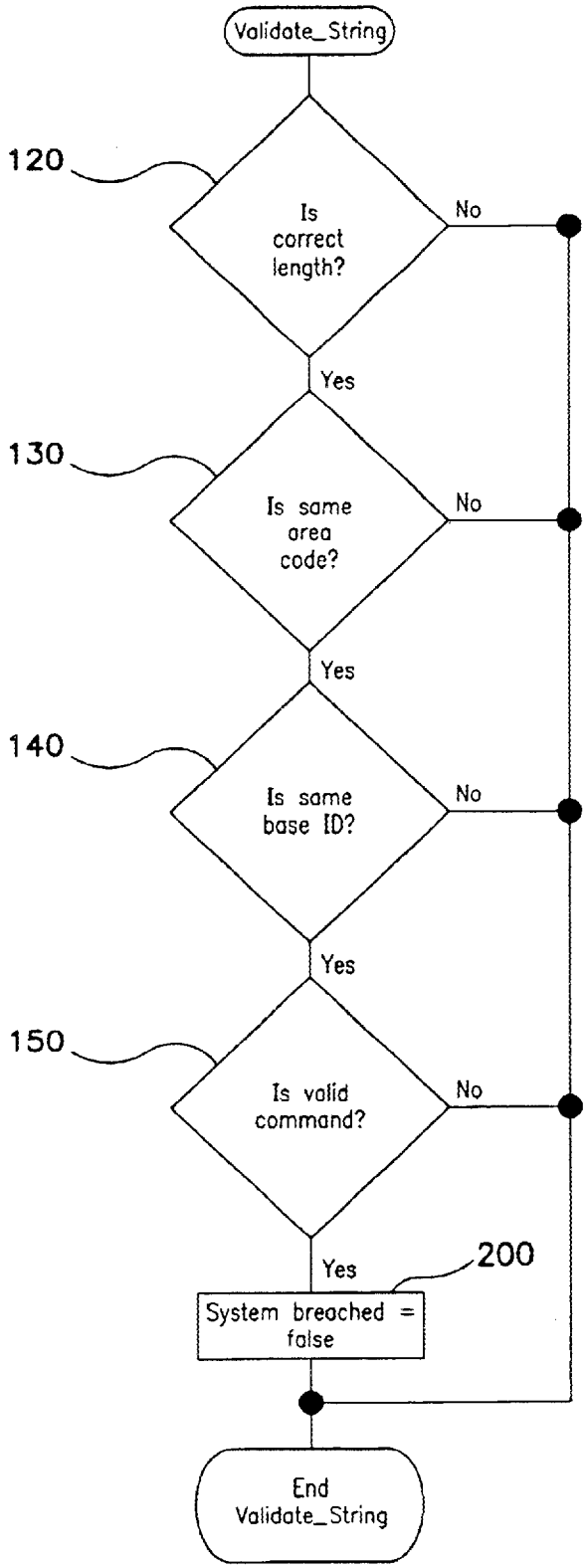
FIG. 3 is a flow chart of a validate string sub-routine called by the main routine of FIG. 2.

Configuration data includes system area code, station ID and counter measure scenario, (a counter measure scenario could be audio/visual contact closures and/or automatic sending of a cancel command to siren or system). On power-up the microcontroller 40 loads configuration data into RAM from EEProm 54 at step 110 of FIG. 2. The operating program of the security device 20*a*, including the main routine of FIG. 2 and the Validate String sub-routine of FIG. 3 are run in the microprocessor RAM to detect a system breach. If detected, the main routine deploys a selected countermeasure scenario. A representative countermeasure scenario is illustrated at steps 100, 102, 104, and 106 of FIG. 2.

The microcontroller 40 has reserved commands for updating data stored in EEPRom Data Storage 54. When these commands are received, the microcontroller 40 will update the corresponding data field or fields.

Depending on the microcontroller used, the EEPRom Data Storage 54 may be external or internal to the microcontroller. Also, the EEPRom Data Storage 54 is interfaced to the microcontroller 40 serially and that protocol is either $I^2C$ or polled, depending on the microcontroller used.

The PC Port Interface 56 connects the microcontroller 40 to a PC's serial or USB port. Through the PC Port Interface, commands and data are exchanged-between the microcontroller 40 and a PC (not illustrated).

User Interface

The user interface 44 is comprised of the Audio/Visual Closures and. Breach Acknowledge functional blocks. The user interface 44 is provides contact closures, if configured as part of a counter measure scenario, when a system breach is detected. The term "contact closures" is used to describe the activation of electronic or electromechanical relays to provide control to user-selected devices that may include audio and/or visual signaling devices. An authorized person may disable (open or de-activate) the audio/visual closures by using the breach acknowledge functionality also provided by the user interface. The breach acknowledge is a control input (contact closure) to the security device 20*a*.

If the microcontroller 40 detects a system breach and if contact closures are configured as a counter measure, contact closures will move from the "Normally Open" to "Normally Closed" state. Likely external equipment connected to the audio/visual closures might be a flashing light or audible alarm device. Activation of these or similar warning devices signals an operator that a system breach has occurred. A breach acknowledgment from an authorized person will revert the contact closures back to the "Normally Open" state.

Radio System

The radio system 22 includes Audio Frequency Protocol (AFP) Transceiver 50 and Base Radio Interface 52 functional blocks. This provides an electrical interface between the security device microcontroller 40 and the signal handling portions (transmitter/antennae) of the radio system 22. Functionality for encoding and decoding either the FSK or DTMF audio frequency protocol signals is provided by this system. It will be understood that the security device radio system may duplicate some functions in the existing equipment.

The Audio Frequency Protocol Transceiver 50 monitors all radio and/or landline communications within the outdoor warning siren system 10. Typically DTMF and/or FSK are the audio frequency protocols (AFPs) being monitored. As each character, as defined by the protocol in use, is detected an interrupt is issued to the microcontroller 40 informing it of the character's presence.

Should the microcontroller 40 require a transmission, the Audio Frequency Protocol Transceiver 50 will convert digital characters from the microcontroller 40 into a format that corresponds to the protocol in use. Several characters together form a string.

The Base Radio Interface 52 provides electrical isolation and signal conditioning between the system's base radio 22 and the microcontroller 40. To accommodate a variety of radios, configuration options may be provided.

Microcontroller

The microcontroller 40 acts as the "brain" of the base station 20. The microcontroller 40 interacts with the functional components of the base station 20 through an operating program uploaded from memory on system power up. System variables such as area code and base station ID are retrieved from Eeprom. The microcontroller:

transmits and receives radio frequency characters through the Audio Frequency Protocol Transceiver 50. The Audio Frequency Protocol Transceiver generates an interrupt to the base station operating program upon reception of a transmission on the system communication RF.

transmit and receive PC commands and data through the PC Port Interface.

when commanded store data to and on power-up retrieve data from EEPRom Data Storage.

following a security breach provide contact closures for any externally connected optional audio/visual alarms.

observe and control radio signals i.e. PTT, Squelch and Channel Grant, using the Base Radio Interface.

accept a user acknowledgment of a system breach through the user interface 44.

The microcontroller 40 is programmed to extract the area code and station ID information from any received AFP string. It will then validate that information against system variables retrieved from EEPRom as shown in FIGS. 2 and 3. If a system breach is detected, then predefined actions, (counter measures) are taken. These actions might be automatic sending of cancel command to the system or siren and/or provide contact closures for external signaling devices to indicate a system breach to relevant personnel.

The software algorithms for the PC Port Interface 56 and Audio Frequency Protocol Transceiver 50 are interrupt driven. The Base Radio Interface 52 and Breach Acknowledge algorithms are polling routines. Sub-routines related to Audio/Visual closures and EEPRom Data Storage 54 are active only when necessary.

The two primary software algorithms relevant to the method disclosed herein are:

the main routine, a relevant portion of which is illustrated in FIG. 2; and the validate_string sub-routine illustrated in FIG. 3.

The main routine is always running and manages polling and general services. FIG. 2 diagrams the functionality of the main routine related to detection and response to a system breach. If the final decision block 300 of the main routine evaluates to Yes, a complete audio frequency protocol (AFP) string has been received, and the Validate_String sub-routine is called, see FIG. 3. Step 120 of FIG. 3 verifies the length of the string being verified. If the string is of the correct length, e.g., 10 characters, then step 130 verifies that the area code contained in the string is that of the evaluating base station. If the area code corresponds to that of the evaluating base station, then step 140 compares the base ID in the string to its own ID. If the base ID in the string is the same as that of the evaluating base station, then step 150 verifies that the command is valid according to the format and encoding used for the relevant warning system 10. If the answer to steps 120, 130, 140 and 150 are all yes, then a system breach is detected at step 200. The Validate_String sub-routine delivers a System Breach Yes to the main routine at step 210. A yes at step 210 of FIG. 2 initiates the countermeasure scenario selected by the outdoor warning system operators. The countermeasure scenario may include activation of the Audio/Visual Closures at step 220, 222 or automatically clearing the activated warning unit or units at steps 100, 102, 104, 106.

Power Bus

The Power Buss 48 brings power into the base station and distributes power to the several components. Power from the Power Bus may be distributed to an external signal encoder.

While a preferred embodiment of the foregoing invention has been set forth for purposes of illustration, the foregoing should not be deemed a limitation of the invention herein. Accordingly, various modifications, adaptations and alternatives may occur to one skilled in the art without departing from the spirit and the scope of the present invention.

What is claimed is:

1. A method for detecting a breach in the integrity of outdoor warning siren system RF communications, the outdoor warning siren system being of the type in which one or more warning units are activated to generate warning signals by RF command signals transmitted by one or more base stations on a system communication radio frequency, the method comprising the steps of:

monitoring the system communication radio frequency to detect command signals;

validating the detected command signal, said step of validating comprising:

decoding the detected command signal to determine a detected command signal base station ID;

comparing the detected command signal base station ID to a base station ID of a detecting base station; and declaring a system breach if the detected command signal base station ID matches the detecting base station ID.

2. The method of claim 1, comprising the step of:

transmitting a command signal de-activating any warning units activated by the detected command signal upon declaration of a system breach.

3. The method of claim 1, comprising the step of:

generating an indication of a system breach upon declaration of a system breach.

4. The method of claim 1, wherein the indication of a system breach comprises audio and visual alarms at each of said one or more base stations.

5. An outdoor warning siren system comprising:

at least one warning unit comprising:

a radio frequency receiver that receives coded transmissions on a system communication radio frequency;

a warning device; and a warning unit controller operatively connected to the radio frequency receiver and the warning device, said warning unit controller being responsive to said coded transmissions to activate or de-activate said warning device, activation of said warning device generating a warning signal;

one or more base stations comprising:

a radio transceiver that encodes and transmits said coded transmissions on said system communication radio frequency, said radio transceiver also arranged to detect and decode said coded transmissions on said system communication radio frequency;

a base station controller arranged to receive decoded transmissions from said radio transceiver and initiate the encoding of said coded transmissions by said radio transceiver, said coded transmissions including a base station ID corresponding to said base station, said base station controller configured to:

compare the base station ID of each decoded transmission to the base station ID of said base station, and if the base station ID of a decoded transmission matches the base station ID of the base station;

declaring a system breach;

said base controller responsive to a system breach by implementing a selected countermeasure scenario.

6. The outdoor warning siren system of claim 5, wherein said selected counter measure scenario comprises:

providing a system breach indication detectable by a person.

7. The outdoor warning siren system of claim 5, wherein said selected counter measure scenario comprises:

automatically generating a coded transmission de-activating any warning units activated by the decoded transmission corresponding to the system breach.

8. A computer-implemented method for detecting a breach in the integrity of an RF communications system, said RF communications system linking one or more base stations to one or more remote units, said computer-implemented method comprising the steps of:

monitoring a system communication RF on which said base stations transmit coded signals to activate and de-activate said remote units, activation of said remote unit causing the activated remote unit to take a pre-determined action and de-activation of said remote unit causing the de-activated remote unit to reverse said pre-determined action, said coded signals including a station ID of the base station generating the coded signal;

decoding a detected signal to determine a detected station ID corresponding to the base station that generated the detected signal;

comparing the detected station ID to a detecting station ID; and declaring a breach in the integrity of the RF communications system if the step of comparing reveals that the detected station ID matches the detecting station ID.

9. The computer-implemented method of claim 8, wherein said step of monitoring is carried out by a base station of an outdoor warning siren system, said remote units are remote warning units activated to produce warning sirens and said method comprises the step of:

implementing a selected counter measure scenario upon declaration a breach.

10. The computer implemented method of claim 9, wherein said step of implementing comprises:

producing a system breach indication detectable by a person; or generating a coded signal to de-activate any remote warning units activated by the detected signal which produced the system breach.

11. The computer implemented method of claim 9, wherein said step of implementing comprises:

producing a system breach indication detectable by a person; and generating a coded signal to de-activate any remote warning units activated by the detected signal which produced the system breach.

* * * * *